US005378185A

United States Patent [19]

Ban

[11] Patent Number: 5,378,185

[45] Date of Patent: Jan. 3, 1995

[54] BUILDING BLOCKS

[75] Inventor: Shichiro Ban, Tsuzuki, Japan

[73] Assignee: Book Loan Publishing Co., Ltd., Hyogo, Japan

[21] Appl. No.: 151,985

[22] Filed: Nov. 15, 1993

[51] Int. Cl.[6] ..... A63H 33/08; A63H 33/06

[52] U.S. Cl. ..... 446/124; 446/120

[58] Field of Search ..... 446/124, 125, 127, 128, 446/121, 120, 104, 85; 52/503, 505, 611, 609, 606

[56] References Cited

U.S. PATENT DOCUMENTS

| | | | |
|---|---|---|---|
| D. 169,482 | 5/1953 | Henke et al. | 446/125 X |
| 614,329 | 11/1898 | Lyle | 52/503 |
| 2,205,404 | 6/1946 | Fuller | 52/504 |
| 2,278,327 | 3/1942 | Magnus et al. | 446/124 |
| 3,838,535 | 10/1974 | Larws | 446/124 |
| 4,007,555 | 2/1977 | Sasaska | 446/127 |
| 4,381,619 | 5/1983 | Griffin | 446/125 |
| 4,582,496 | 4/1986 | Larws | 446/124 X |
| 4,833,856 | 5/1989 | Zwagerman | 446/127 X |
| 5,215,490 | 6/1993 | Szoradi | 446/125 X |

FOREIGN PATENT DOCUMENTS

| | | | |
|---|---|---|---|
| 1491466 | 7/1967 | France | 446/125 |
| 57-60034 | 12/1982 | Japan . | |

*Primary Examiner*—Robert A. Hafer
*Assistant Examiner*—D. Neal Muir

[57] ABSTRACT

A plurality of blocks, used for a block toy, each of which is formed by mutually connecting unit blocks selected from a first to a 25th unit block, the unit blocks being made by cutting an imaginary base block by four horizontal imaginary cutting planes parallel to each other and four vertical imaginally cutting planes parallel to each other in such a way that each unit block is designated the first to 25th unit block, respectively, arranged from left to right and from top to bottom. In order to build up a structure, a first and a second group of blocks are used in combination. That is, the blocks of the first group are structured by connecting a unit block or unit blocks selected from the 11th through 15th unit block to the unit blocks corresponding to the second, fourth, seventh through ninth, 17th through 19th, 22nd and 24th unit block, while the blocks of the second group are structured by connecting a unit block or unit blocks selected from the second through fourth unit block and/or the 22nd through 24th unit block to the unit blocks corresponding to the seventh through ninth, 12th, 14th, and 17th through 19th unit block.

21 Claims, 19 Drawing Sheets

BUILDING BLOCKS

BACKGROUND OF THE INVENTION

1. Field of the Invention

The present invention relates to a block toy able to construct a variety of structures by connecting a plurality of blocks to each other.

2. Description of the Related Arts

Conventionally, there have been proposed various types of block toys. For example, one known block toy is shown in Japanese Laid-Open Patent Publication No. 57-60034, which discloses that each block 102 of the block toy is constructed approximately H-shaped with a through-hole formed in the center thereof, referring to FIG. 1. In order to connect blocks 102 to each other, two blocks 102 adjacent to each other are sandwiched in between a pair of legs of another block 102. As shown in FIG. 1, each block 102 is constructed to be the same in its configuration with a unit dimension [a]. These blocks have a characteristic and an advantage that they can be freely connected to each other in such a way that they are aligned in one direction, in two or three dimensions. Two adjacent blocks do not have, however, a self-connecting function, i.e., they cannot be connected to each other without the intermediary of a third block. In addition, these blocks have such a disadvantage as when they are connected to each other, at least one side surface of a structure never falls to become uneven in appearance, i.e., the lateral of a block is not flushed with that of another block connected to the former on the side and it is impossible to make all the side surfaces of the structure flat and even.

SUMMARY OF THE INVENTION

It is an object of the present invention to provide a block toy including blocks having a self-connecting function.

It is another object of the present invention to provide a block toy including blocks which make it possible to flush the lateral of a block with that of another block connected to the former on each side of a structure built up by them.

In accomplishing these and other objects of the present invention, there is provided a block toy comprising any desired blocks selected from blocks belonging to six different types of blocks, namely a first to a sixth block each of which is symmetrical with respect to a line, each of which is formed by connecting at least one desired unit block selected from a 11th through a 15th unit block (K–O) to essential unit blocks (B, D, G, H, I, L, N, Q, R, S, V, and X) corresponding to a second, fourth, seventh, eighth, ninth, 17th, 18th, 19th, 22nd and 24th unit block, wherein it is assumed that twenty-five unit blocks (A–Y) from a first to a 25th unit block are formed from a rectangular base block [8×a] in vertical length, [6×a] in horizontal length and [2×a] in thickness by dividing the base block by four vertical cutting planes from a first to a fourth plane arranged from left to right in parallel with each other and by four horizontal cutting planes from a first to a fourth plane arranged from top to bottom in parallel with each other, designating a unit block (A) at a left upper corner of the base block (Y) the first unit block, a unit block at a right lower corner thereof the 25th unit block, and each of the other unit blocks (B–X) the second to the 24th unit block, respectively, arranged from an upper first to a lower fifth row and from a left first to a right fifth column, that a vertical length of each unit block (A–E, K–O, U–Y) on the first, third and fifth row is [2×a] whereas that of each unit block on the second and fourth row is [a], and that a horizontal length of each unit block (A, F, K, P, U; B, G, L, Q, V; D, I, N, S, X; E, J, O, T, V) on the first, second, fourth and fifth column is [a]whereas that of each unit block (C, H, M, R, W) on the third column is [2×a].

According to the above construction, mutually adjacent blocks can be connected to each other without the intermediary of a third block, and the lateral of a block can be flushed with that of another block connected thereto on each side of a structure constructed from them, thus making all the side surfaces thereof flat and even.

Preferably, the block(s) is/are used in combination with a block or blocks selected from blocks belonging to four different types of blocks, namely a seventh to a tenth block each of which is symmetrical with respect to a line, each of which is formed by connecting at least one desired unit block selected from the second through fourth unit block and/or the 22nd through 24th unit block to essential unit blocks corresponding to the seventh, eighth, ninth, 12th, 14th, 17th, 18th and 19th unit block. Each side surface of a structure formed by mutually connecting blocks selected from blocks belonging to the first through sixth block can be flat and even; however, it cannot necessarily be made smooth and level, i. e., it becomes step-like in appearance. The use of the block(s) selected from blocks belonging to the first through sixth block in combination with the block(s) selected from blocks belonging to the seventh through 10th block can lead to a structure with all the side surfaces being smooth and level.

Preferably, the block(s) selected from blocks belonging to the first through sixth block, or the blocks selected from both blocks belonging to the first through sixth block and blocks belonging to the seventh and 10th block is/are used in combination with an 11th block or 11th blocks and/or a 12th block or 12th blocks and/or a 13th block or 13th blocks, the 11th block comprising modified unit blocks each of which is formed by vertically reducing the second, fourth, 22nd and 24th unit block by half respectively, and the seventh, ninth, 12th, 13th, 14th, 17th and 19th unit block, connected to each other; the 12th block comprising modified unit blocks each of which is formed by vertically reducing the second, fourth, 12th, 13th, 14th, 22nd and 24th unit block by half respectively, and the seventh, ninth, 17th and 19th unit block, connected to each other; and the 13th block comprising modified unit blocks each of which is formed by reducing the seventh, eighth, ninth, 12th, 14th, 17th, 18th and 19th unit block by half in a thickness direction respectively, and the third unit block, connected to each other so that the third unit block projects only on one side in the thickness direction, which can expand the diversity of structures of the block toy.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
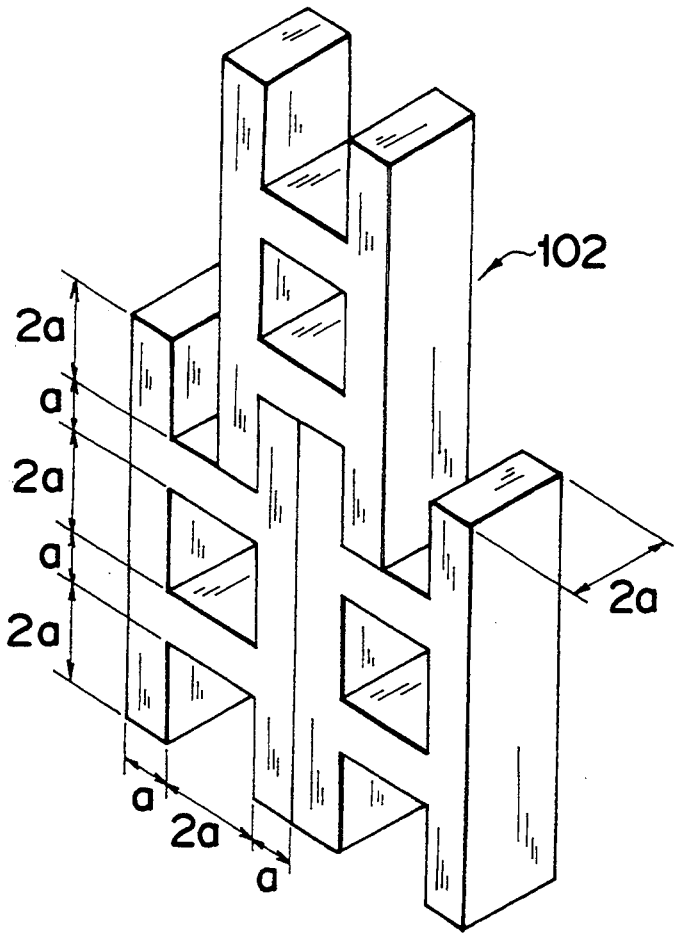
Fig.1 PRIOR ART
FIG. 1 is a perspective view showing a conventional block toy.

Before the description of the present invention proceeds, it is to be noted that like parts are designated by like reference numerals throughout the accompanying drawings, and any dimension is designated in brackets throughout the specification.

A block toy according to an embodiment of the present invention is described below with reference to FIGS. 1 through 25.

The block toy has structures shown in FIGS. 1 through 20.

Figure 2:
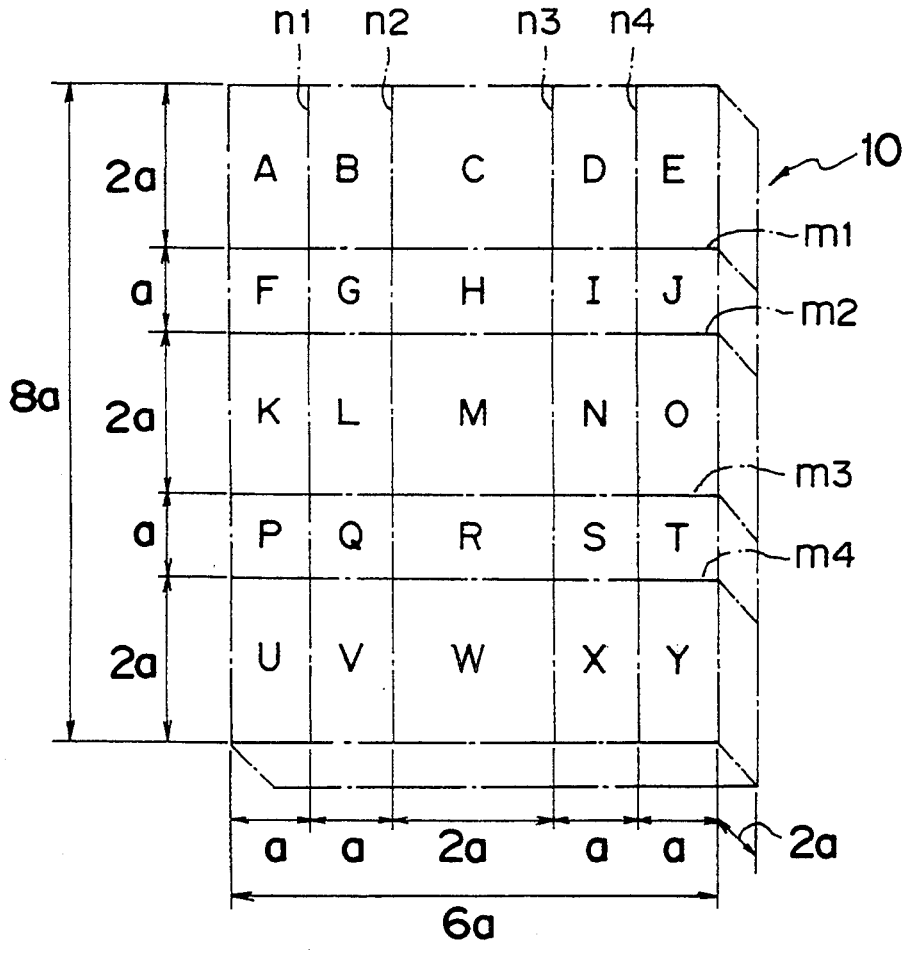
FIG. 2 is a perspective view showing an imaginary base block used to constitute blocks according to an embodiment of the present invention.

Each block is constituted based on an imaginary base block 10 shown in FIG. 2. The base block 10 is a rectangular solid which is [8×a] in vertical length, [6×a] in horizontal length, and [2×a] in thickness, supposing that a unit dimension is [a]. The base block 10 is divided by vertical imaginary cutting planes n1–n4 arranged from left to right in parallel with each other. The base block 10 is also divided by horizontal imaginary cutting planes m1–m4 arranged from top to bottom in parallel with each other. Consequently, counting from a first unit block to a 25th unit block, twenty-five unit blocks are formed in total, each unit block of which is denoted by "A" to "Y" respectively in alphabetical order in the figure. That is, a unit block disposed at the left uppermost corner of the base block 10 is denoted by a first unit block A and a unit block disposed at the right lowermost corner thereof is denoted by a 25th unit block Y. The other unit blocks are denoted by B through X arranged in the order from the uppermost to the lowermost row and from the left to the right column.

The vertical and horizontal lengths of the unit blocks A through Y are set as follows: With respect to the vertical length of each unit block, the unit blocks A to E on the first row, those K to 0 on the third row, and those U to Y on the fifth row, have the same vertical length [2×a], while the unit blocks F to J on the second row, and those P to T on the fourth row, have the same vertical length [a].

With respect to the horizontal length of each unit block, the unit blocks A, F, K, P, U on the first column, those B, G, L, Q, v on the second column, those D, I, N, S, X on the fourth column, and those E, J, Q, T, Y on the fifth column have the same horizontal length [a], while the unit blocks C, H, M, R, W on the third column have the same horizontal length [2×a].

Figure 3:
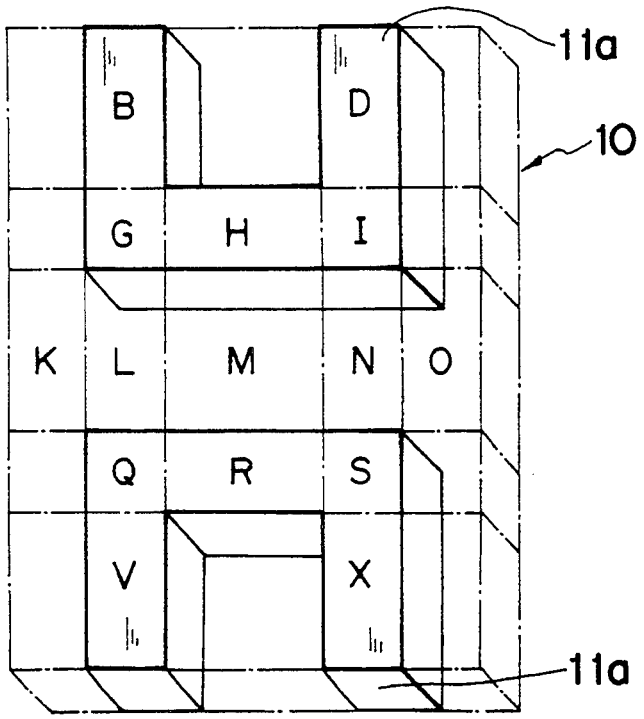
FIG. 3 is a perspective view showing a pair of essential unit blocks of a first group according to the present invention.

Each block constituting a first group, namely, a first through a sixth block shown in FIGS. 4–9, respectively, is composed of a pair of essential unit blocks 11*a* and at least one desired unit block selected from selective unit blocks of the base block 10 as shown in FIG. 3. More specifically, the essential unit blocks 11*a* shown by a solid line in FIG. 3 comprise a pair of U-shaped portions, one of which includes the unit blocks B, D, G, H, I, and the other of which includes Q, R, S, V, X. The selective unit blocks to be connected to the essential blocks 11*a* are the blocks K–O. Neither the block K nor 0 can be used alone as a selective unit block because the two essential unit blocks 11*a* cannot be connected to each other thereby; consequently, it is always used in combination with other selective unit block(s) L or N or both if necessary. The first through sixth block shown in FIGS. 4–9 are described below.

Figure 4A:
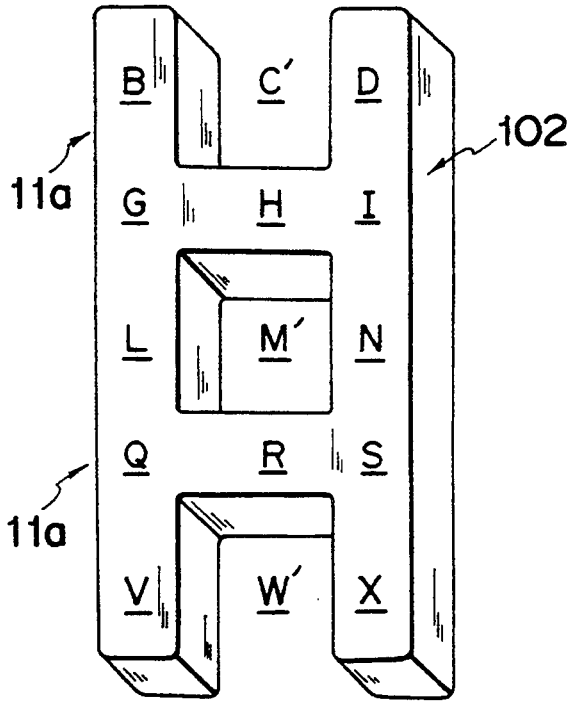
FIG. 4(A) is a front perspective view showing a first block of the first group.

The structure of the first block 102 of the first group shown in FIG. 4(A) is the same as that of the conventional block shown in FIG. 1.

Figure 4B:
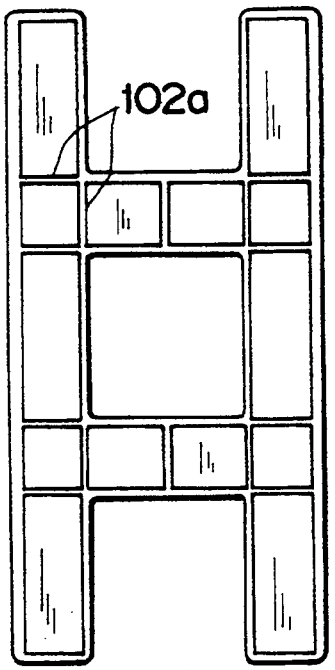
FIG. 4(B) is a rear view of the first block shown in FIG. 4(A)

That is, the first block 102 is composed of the essential blocks 11*a* and the selective unit blocks L and N. It is preferable that each of the unit blocks A to Y is made hollow on its back side for the sake of saving material in production and that its back side is reinforced with such ribs 102*a* as shown in FIG. 4(B).

Figure 5:
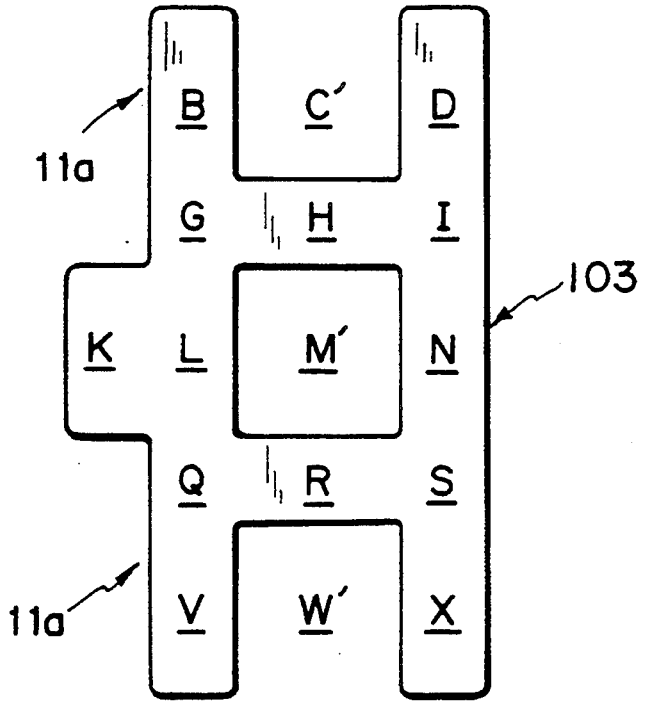
FIG. 5 is a front view showing a second block of the first group.

The second block 103 shown in FIG. 5 is formed by connecting a selective unit block K to the selective unit block L of the first block 102.

Figure 6:
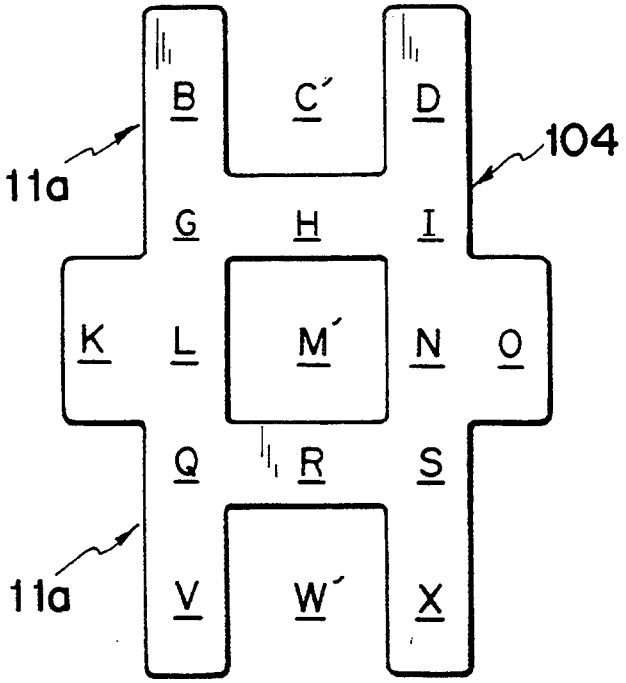
FIG. 6 is a front view showing a third block of the first group.

The third block 104 shown in FIG. 6 is formed by connecting a selective unit block O to the selective unit block N of the second block 103.

Figure 7:
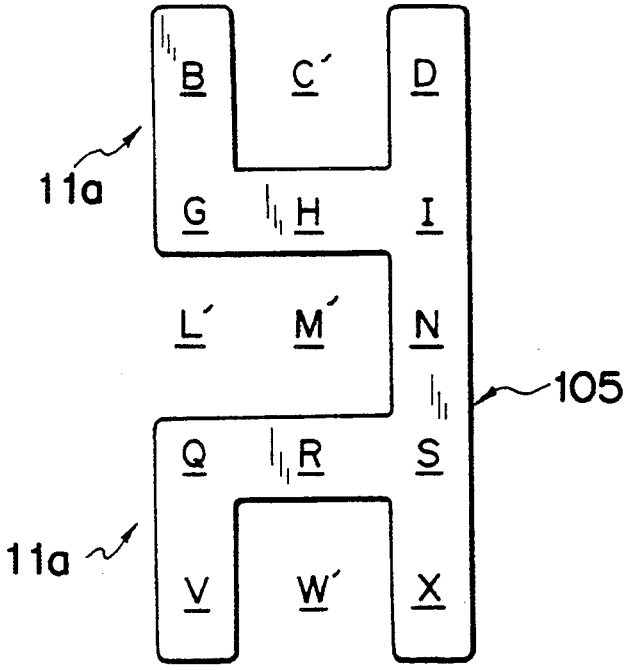
FIG. 7 is a front view showing a fourth block of the first group.

The fourth block 105 shown in FIG. 7 is formed by removing the selective unit block L from the first block 102. Hence, the fourth block 105 has a space composed of a lacking portion M' corresponding to the selective unit block M and a lacking portion L' corresponding to L. It is noted that, throughout the specification and the figures, each lacking portion corresponding to its unit block is represented by a reference symbol with apostrophe like L' and M'.

Figure 8:
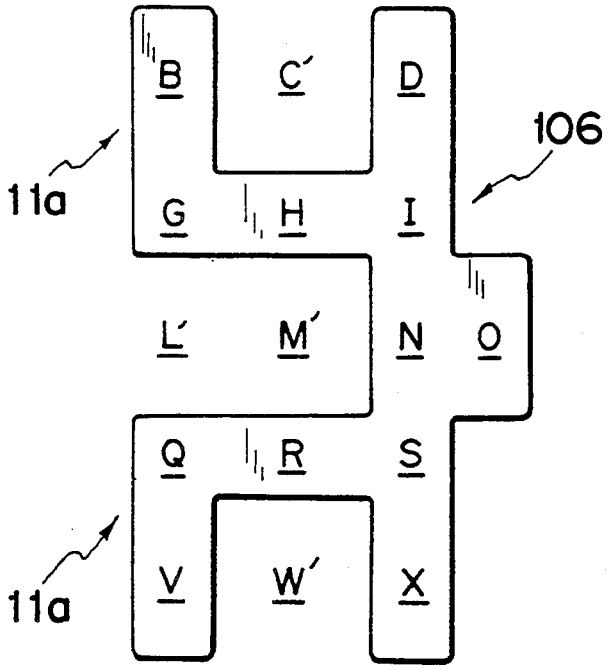
FIG. 8 is a front view showing a fifth block of the first group.

The fifth block 106 shown in FIG. 8 is formed by connecting a selective unit block O to the selective unit block N of the fourth block 105.

Figure 9:
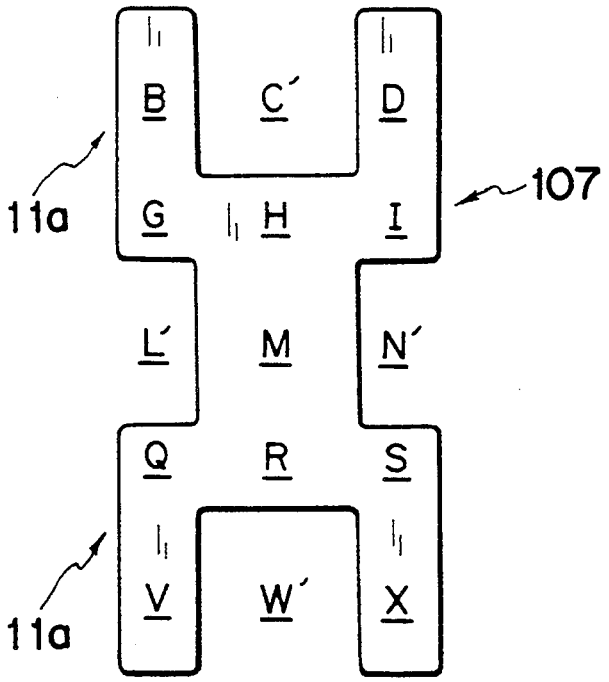
FIG. 9 is a front view showing a sixth block of the first group.

The sixth block 107 shown in FIG. 9 is formed by sandwiching the selective unit block M in between the essential unit blocks 11*a*.

Each block belonging to the first through sixth block 102–107 is symmetrical with respect to a vertical center line and/or a horizontal center line.

Figure 11:
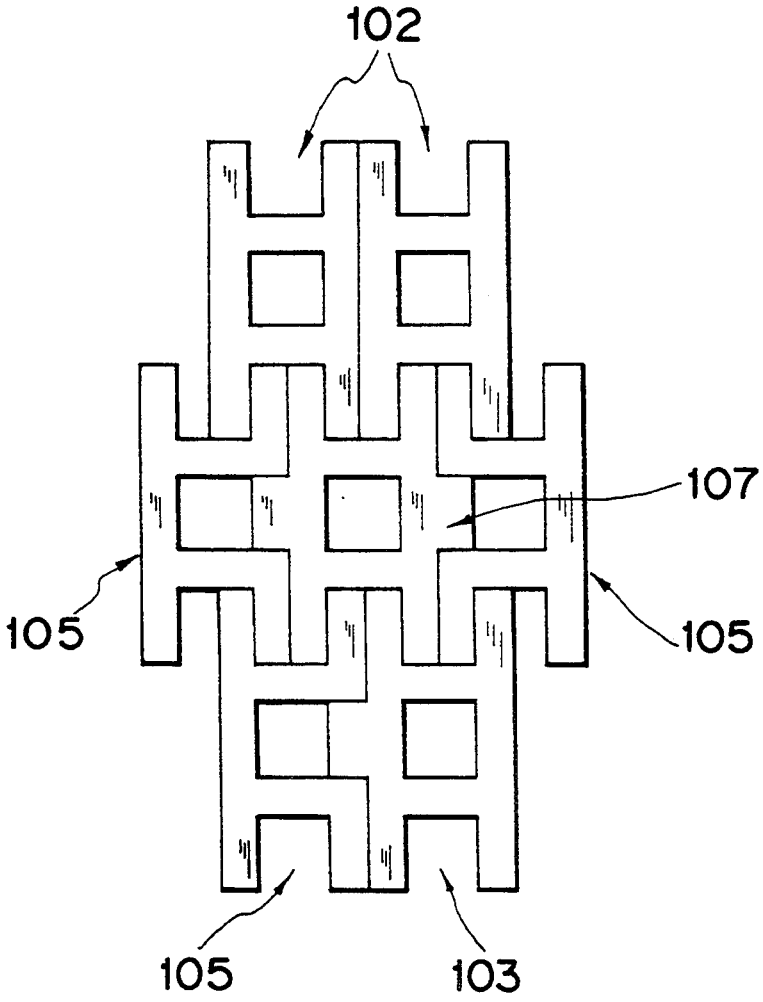
FIG. 11 is a front view showing an example of a structure formed by combining a plurality of blocks of the first group with each other in two dimensions.
Figure 12:
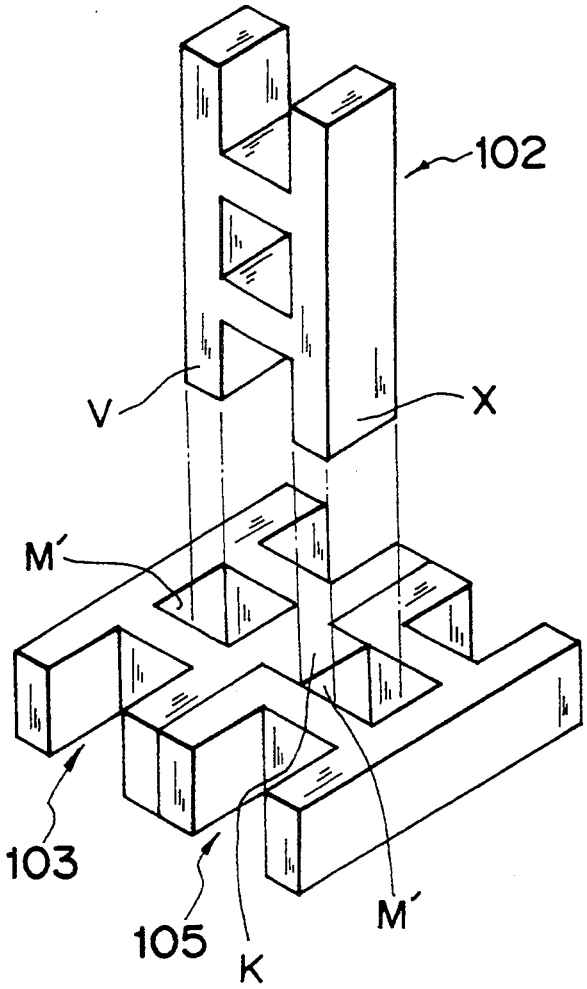
FIG. 12 is an explanatory, perspective view showing an example of a structure formed by combining a plurality of blocks of the first group with each other in three dimensions.

It is possible to form structures with various configurations by connecting any desired blocks belonging to the first through sixth block 102–107 to each other in such a way that they are aligned in one direction, in two or three dimensions. FIG. 10 shows structures with various configurations formed by connecting those blocks to each other in one direction. FIG. 11 shows an example of a structure with a configuration formed by connecting them to each other in two dimensions. FIG. 12 shows an example of a structure with a configuration formed by connecting them to each other in three dimensions.

Figure 10A:
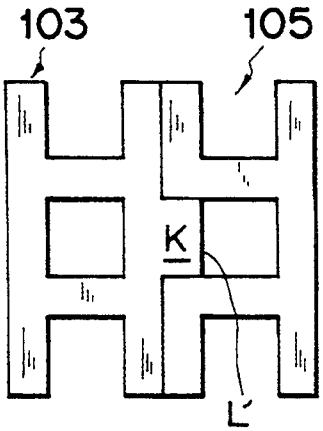
FIG. 10(A) through 10(E) are front views showing examples of structures formed by combining a plurality of blocks of the first group with each other in one direction.

FIG. 10(A) shows a structure formed by connecting a second block 103 and a fourth block 105 to each other. That is, the second block 103 and the fourth block 105 are connected to each other by engaging the selective unit block K of the second block 103 with the lacking portion L' of the fourth block 105.

Figure 10B:
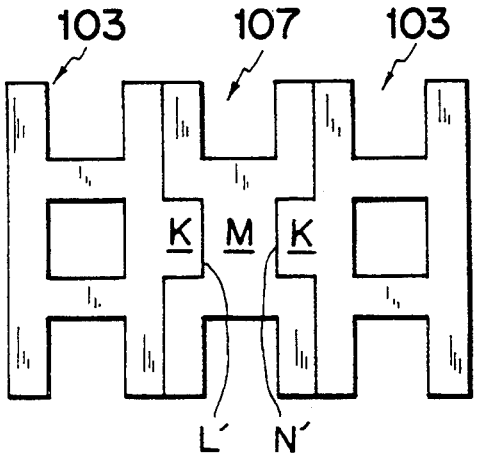

FIG. 10(B) shows a structure formed by connecting a second block 103, a sixth block 107, and another second block 103 to each other in this order. The two second blocks 103 are connected to the sixth block 107 by engaging the selective unit blocks K of the second blocks 103 with the lacking portions L' and N' of the sixth block 107.

Figure 10C:
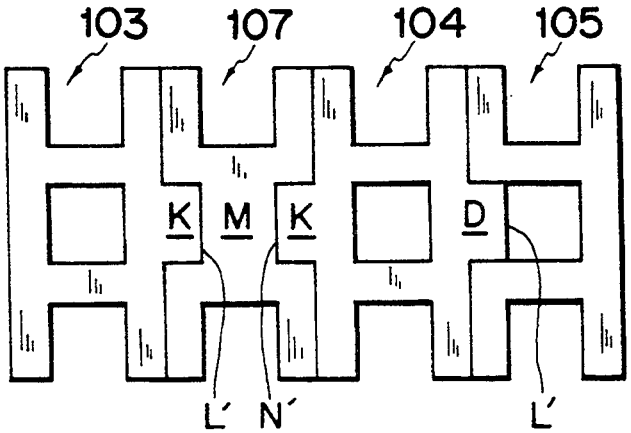

FIG. 10(C) shows a structure formed by connecting a second block 103, a sixth block 107, a third block 104, and a fourth block 105 to each other in one direction. The second block 103, the sixth block 107, and the third block 104 are connected to each other in the same manner as that shown in FIG. 10(B); and the third block 104 and the fourth block 105 are connected to each other in the same manner as that shown in FIG. 10(A).

Figure 10D:
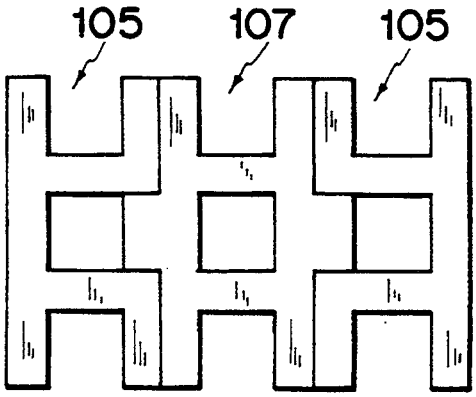
Figure 10E:
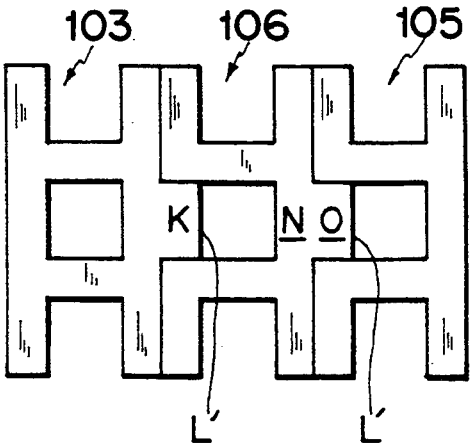

FIG. 10(D) shows a structure formed by connecting a fourth block 105, a third block 104, and a fourth block 105 to each other in this order. FIG. 10(E) shows a structure formed by connecting a second block 103, a fifth block 106, and a fourth block 105 to each other in this order. The methods of engaging blocks with each other as shown in FIGS. 10(D) and 10(E) would be apparent from the descriptions made on FIGS. 10(A-)-10(C). The structures shown in FIGS. 10(A)-10(E) are formed by connecting a plurality of desired blocks belonging to the second through sixth block 103–107 to each other. As shown in FIGS. 10(A)-10(E), both vertical side surfaces of each structure are flat and straight.

Each of blocks 102–107 is of self-connection type, i.e., mutually adjacent blocks can be connected to each other without the intermediary of a third block.

FIG. 11 shows one example of a structure formed by connecting some blocks belonging to the first through sixth block 102–107 to each other in two dimensions. That is, the structure is formed by connecting a pair of the first blocks 102 and the structure shown in FIG. 10(A) to the upper and lower end portions of the structure shown in FIG. 10(D), respectively. The adjacent unit blocks V, B:D, B of the structure shown in FIG. 10(D) are sandwiched in between the unit blocks V and X of a pair of the first blocks 102 disposed adjacently. The structure shown in FIG. 10(D) and that shown in FIG. 10(A) are connected to each other similarly.

FIG. 12 shows one example of a structure formed by connecting some blocks belonging to the first through sixth block 102–107 to each other in three dimensions. The structure is formed by vertically connecting the first block 102 to the structure of two dimensions shown in FIG. 10(A). That is, the unit blocks V and X of the first block 102 are inserted into the lacking portions M' of the second and fourth blocks 103 and 105, thus sandwiching the unit blocks K and L of the second block 103 between the unit blocks V and X of the first block 102. Needless to say, any desired block(s) belonging to the group of the second through sixth block 103–107 can be perpendicularly connected to the structures of two dimensions shown in FIGS. 10(C)-10(E) and in FIG. 11.

As described above, the side surfaces of structures formed by mutually connecting desired blocks selected from blocks belonging to the first through sixth block 102–107 in two dimensions cannot necessarily be made smooth and level. In order to solve this problem, it is preferable that a block or blocks belonging to a seventh through a tenth block 108–111 constituting a second group of blocks, as described below with reference to FIG. 13–17, is/are selectively used in combination with any desired block(s) of the first group.

Figure 13:
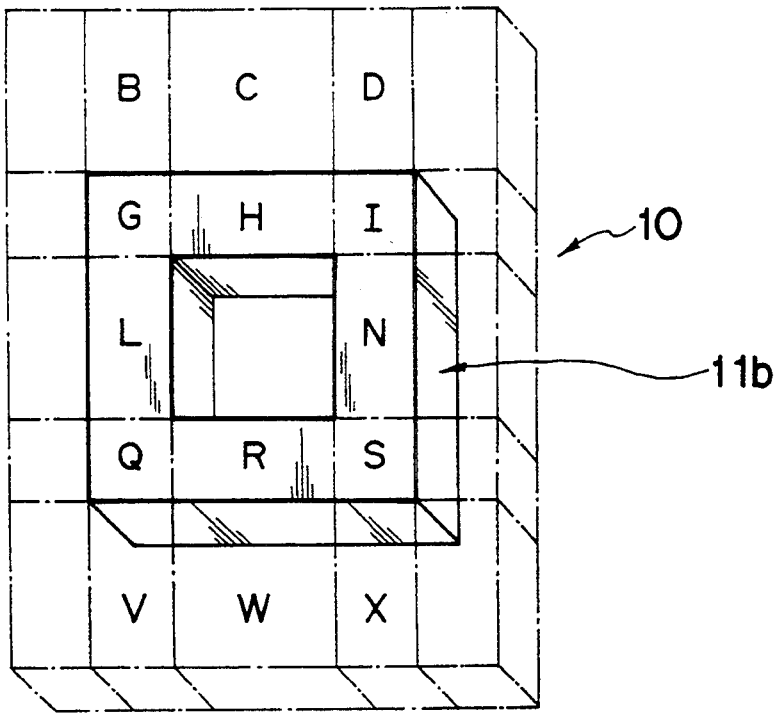
FIG. 13 is a perspective view showing an essential unit block used to constitute blocks of a second group according to the present invention.

Each of the blocks 108–111 of the second group is composed of an essential unit block 11*b* structured in the form of a hollow square, and at least one desired block selected from selective unit blocks, connected to each other. More specifically, the essential unit block 11*b* comprises the seventh, eighth, ninth, 12th, 14th, 17th, 18th and 19th unit block G, H, I, L, N, Q, R and S connected to each other, to which one or more unit blocks, selected from selective unit blocks B, C, D, V, W and X on the first and fifth row of the base block 10, are connected, as shown in FIG. 13. FIGS. 14–17 show the blocks 108–111 belonging to the second group. As shown in these figures, each of the blocks 108–111 is symmetrical with respect to a vertical and/or a horizontal line, and this second group of blocks does not include blocks which are not symmetrical with respect to a vertical and/or a horizontal line. As apparent from FIGS. 4 and 13, the first block 102 of the first group is included in the second group as well.

Figure 14:
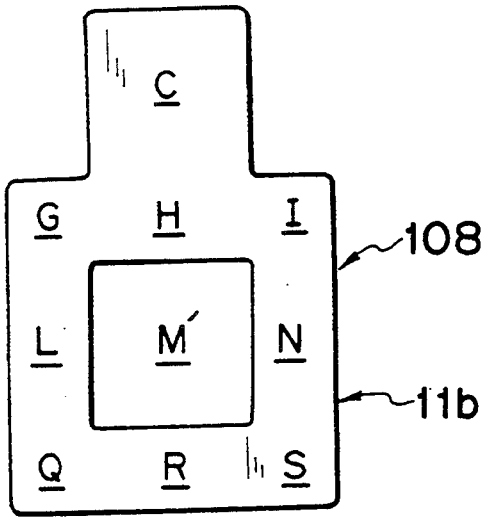
FIG. 14 is a front view showing a seventh block of the second group.

FIG. 14 shows the seventh block 108 formed by connecting a selective unit block C to the unit block H of the essential unit block 11*b*.

Figure 15:
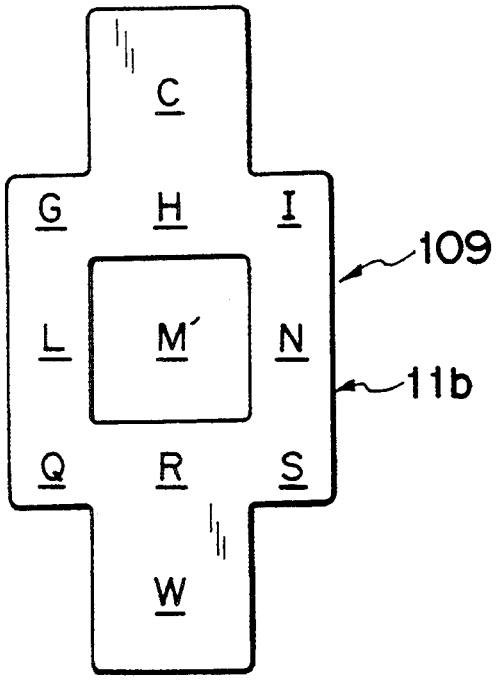
FIG. 15 is a front view showing an eighth block of the second group.

FIG. 15 shows the eighth block 109 formed by connecting a selective unit block W to the unit block R of the seventh block 108.

Figure 16:
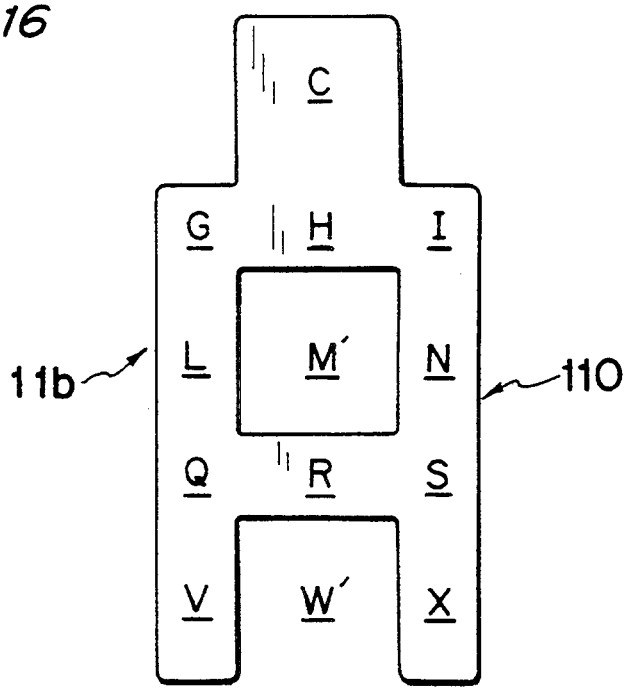
FIG. 16 is a front view showing a ninth block of the second group.

FIG. 16 shows the ninth block 110 formed by connecting the selective unit blocks V and X to the unit blocks Q and S of the seventh block 108.

Figure 17:
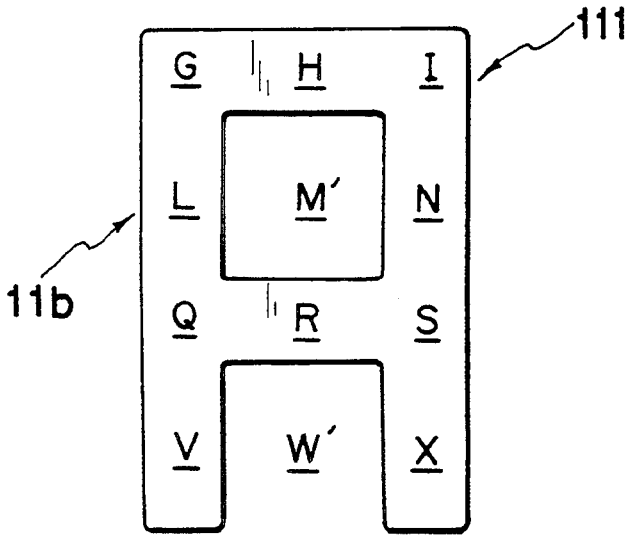
FIG. 17 is a front view showing a tenth block of the second group.

FIG. 17 shows the tenth block 111 formed by removing the selective unit block C from the ninth block 110.

Figure 18A:
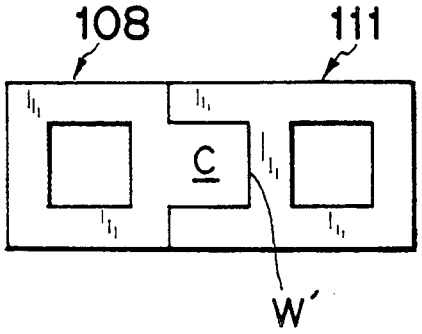
FIG. 18(A) through 18(D) are front views showing structures formed by connecting blocks of the second group to each other in one direction.

FIGS. 18(A)–18(D) show structures formed by connecting some of the blocks 108–111 of the second group to each other in one direction. FIG. 18(A) shows a structure formed by engaging the unit block C of a seventh block 108 with the lacking portion W' of a tenth block 111.

Figure 18B:
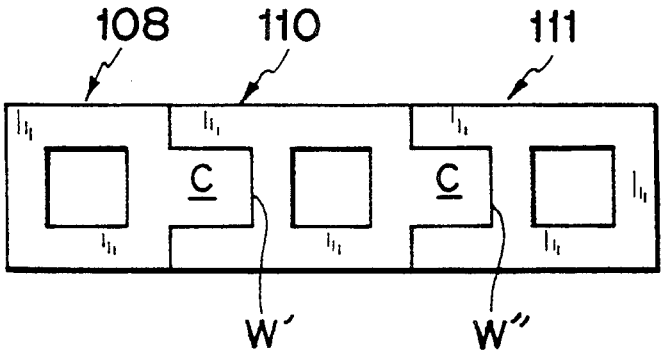

FIG. 18(B) shows a structure formed by inserting a ninth block 110 between a seventh block 108 and a tenth block 111. More specifically, the unit block C of the seventh block 108 is inserted into the lacking portion W' of the ninth block 110, and the unit block C of the ninth block 110 is inserted into the lacking portion W' of the tenth block 111.

Figure 18C:
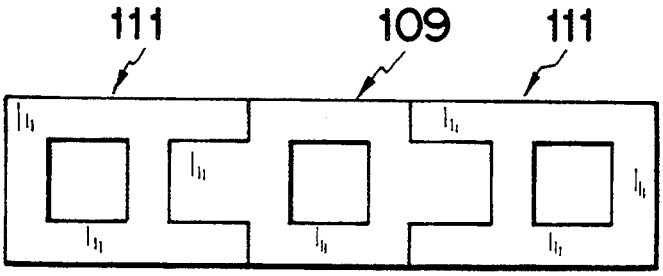

FIG. 18(C) shows a structure formed by connecting a pair of tenth blocks 111 to both sides of a eighth block 109 with the selective unit blocks C and W of the eighth block 109 being inserted into the lacking portions W' of the tenth blocks 111.

Figure 18D:
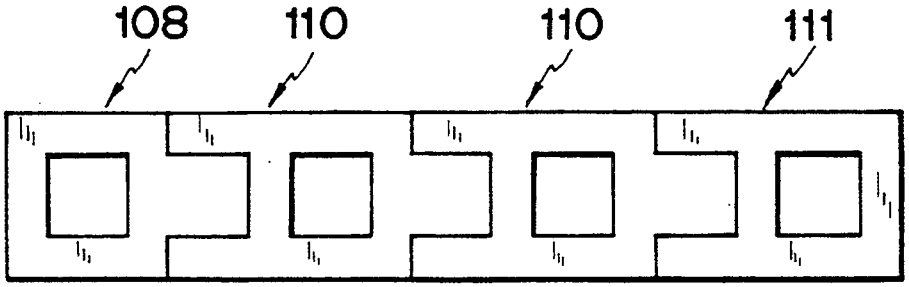
Figure 19:
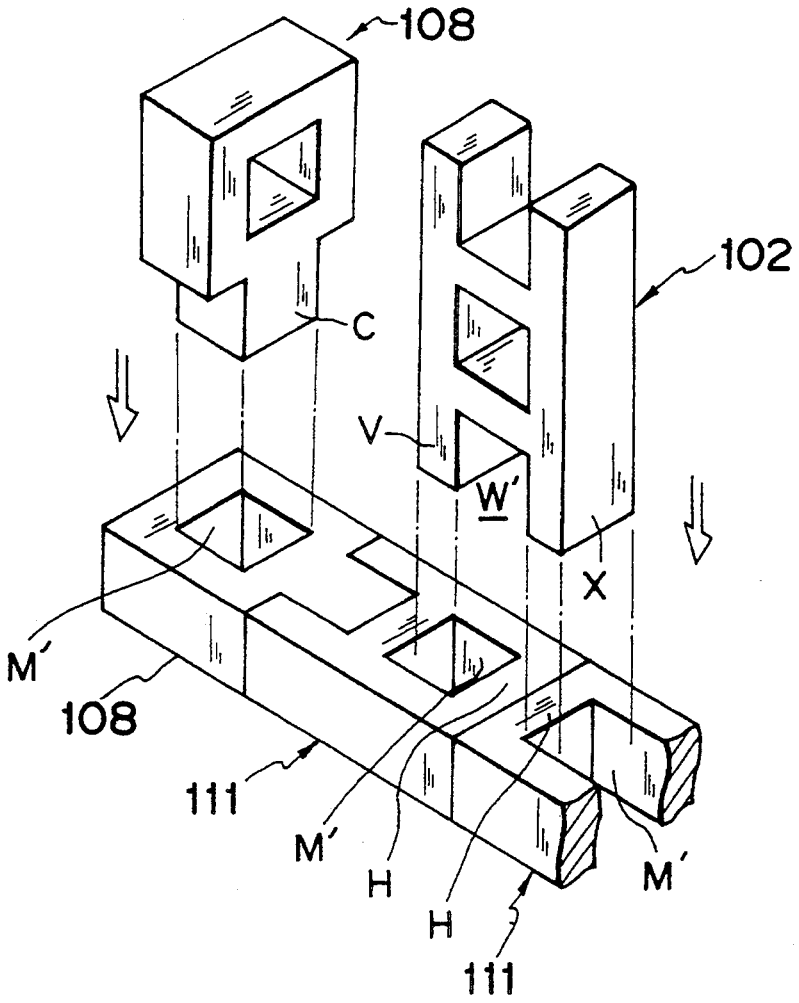
FIG. 19 is an explanatory, perspective view showing how to connect blocks of the first and second group to each other in three dimensions.

FIG. 18(D) shows a structure formed by connecting a seventh block 108, a pair of ninth blocks 110 and a tenth block 111 to each other in this order. The methods of connecting these blocks shown in FIGS. 18(C) and 18(D) would be apparent from the descriptions made on FIGS. 18(A) and The blocks 108–111 of the second group are of self-connection type as apparent from the descriptions made with reference to FIG. 18, and they can be connected to each other in one direction. In addition, they can be connected to each other in three dimensions as shown in FIG. 19. This figure shows one example of the way a first block 102, a pair of seventh block 108 and a pair of tenth blocks 111 are connected to each other in three dimensions. In this example, these blocks 102, 108 and 111 are connected mutually in such a way that a selective unit block C of one seventh block 108 is inserted into the lacking portion M' of the other seventh block 108, that a pair of essential unit blocks V and X of a first block 102 are inserted into the lacking portions M' of the tenth blocks 111 arranged adjacently so that the essential unit blocks H of the tenth blocks 111 are sandwiched in between the essential unit blocks V and X of the first block 102, and that a selective unit block C of the other seventh block 108 is inserted into the lacking portion W' of one of the tenth blocks 111.

Figure 20:
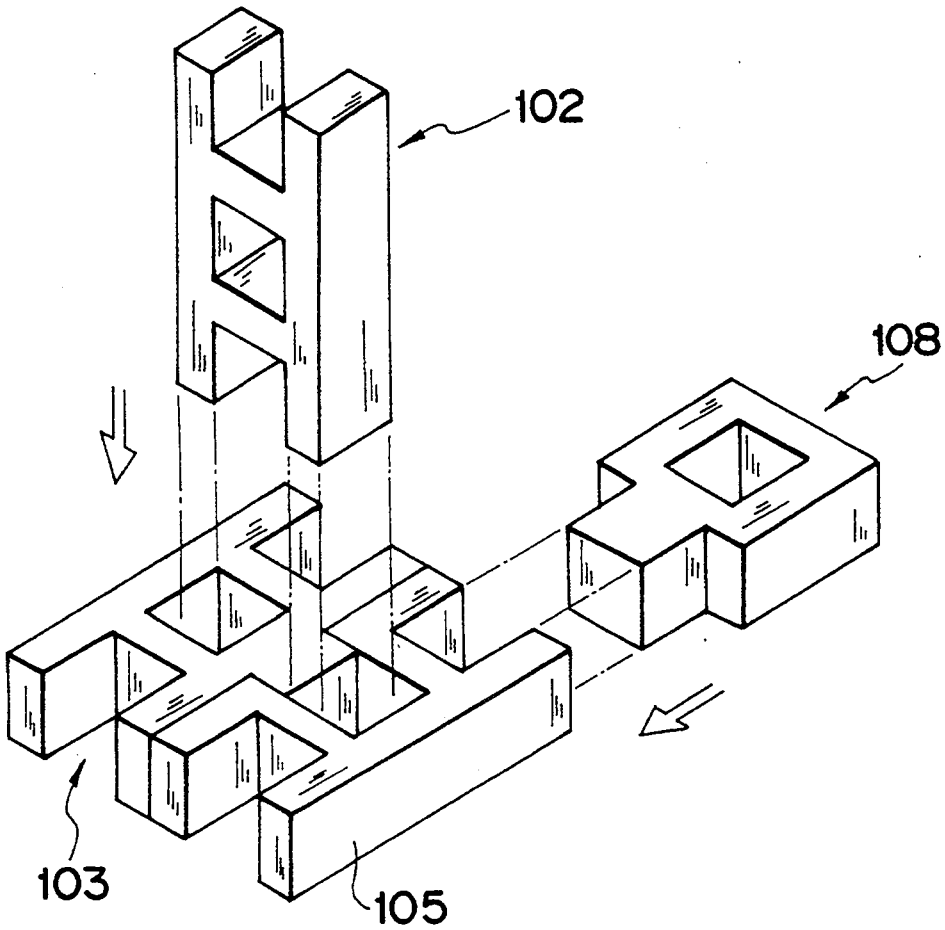
FIG. 20 is an explanatory, perspective view showing how to connect blocks of the first and second group to each other in two and three dimensions.

FIG. 20 shows an example of a three-dimensional structure formed by mutually connecting some desired blocks selected from both the first and second group. That is, the structure is built up by connecting a second block 103 and a fourth block 105 to each other in a first direction, connecting a seventh block 108 to the fourth block 105 in a second direction perpendicular to the first direction, and connecting a first block 102 to the second block 103 in a third direction perpendicular to the plane defined by the first and second direction. As shown in FIG. 20, the combination of blocks belonging to the first group and the block 108 to the second group can lead to a two-dimensional structure having no step-like side surface as that of the two-dimensional structure, as shown in FIG. 11, consisting of blocks belonging to the first group only. That is, the side surface of the seventh block 108 of the second group is flush with that of the fourth block 105 of the first group.

As apparent from the above description, both objects of the present invention can be achieved by using some desired blocks selected from the blocks belonging to the first group, and using a block or blocks selected from the blocks belonging to the second group in combination with the block(s) belonging to the first group can make side surfaces of structures smooth and level. Needless to say, it is not necessary to use all of the blocks 102 through 107 of the first group in composing a block structure. Also, in case that blocks of the first and second group are mixedly used to build up a structure, a set of only desired blocks selected therefrom can be employed, not necessarily all of the blocks need to be used. In each case, however, blocks of the same particular types belonging to the first through sixth block 102–107, or belonging to the first through 10th block 102–111, may be repeatedly used as shown above.

It goes without saying that other blocks not belonging to the first nor to the second group may be used in combination with the blocks of the first and second group. For example, a wide variety of structures can be constructed by using 11th, 12th, and 13th blocks 112, 113, and 114 shown in FIGS. 21, 22, and 24, respectively.

Figure 21:
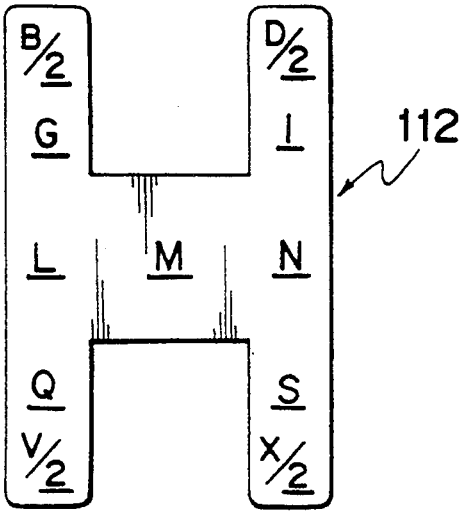
FIG. 21 is a front view showing an 11th block not belonging to the first nor to the second group.

The 11th block 112 shown in FIG. 21, which is a modification of the first block 102, comprises a seventh, ninth, 12th, 13th, 14th, 17th, 19th unit block G, I, L, M, N, Q, S, and a block B/2, D/2, V/2, X/2 each of which is formed by vertically reducing a second, fourth, 22nd, 24th unit block B, D, V, X by half respectively, connected to each other.

Figure 22:
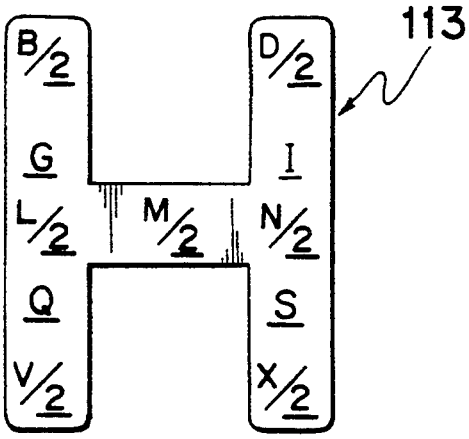
FIG. 22 is a front view showing a 12th block not belonging to the first nor to the second group.

The 12th block 113 shown in FIG. 22, which is a modification of the first block 102, comprises a seventh, ninth, 17th, 19th unit block G, I, Q, S and a block B/2, D/2, L/2, V/2, X/2 each of which is formed by vertically reducing a second, fourth, 12th, 13th, 14th, 22nd, 24th unit block B, D, L, M, N, V, X by half respectively, connected to each other.

Figure 23:
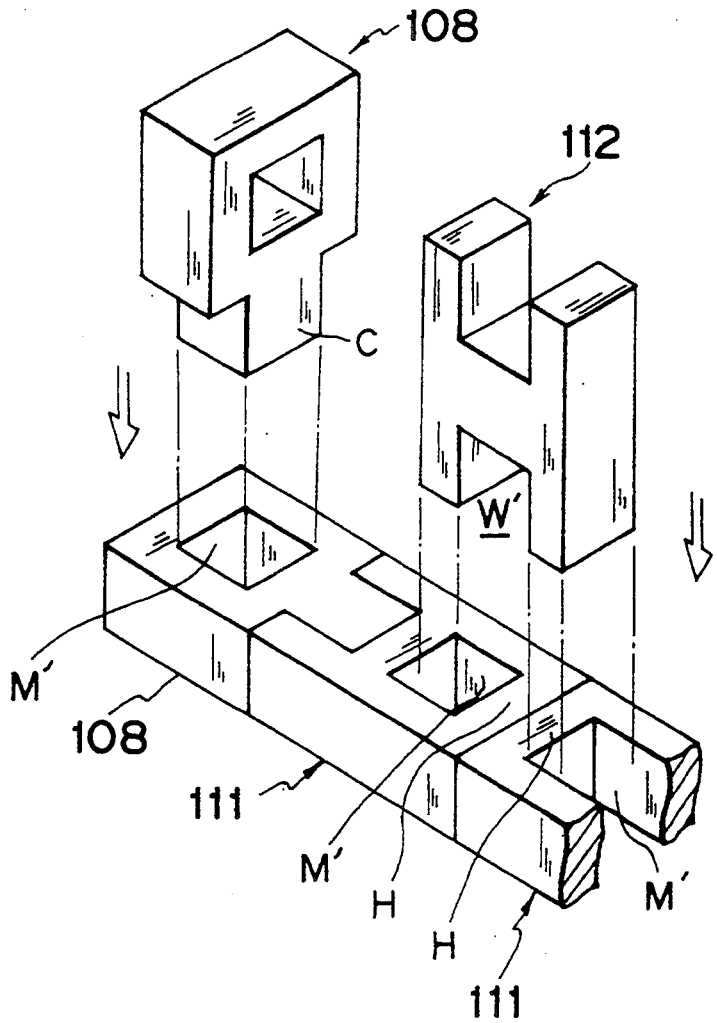
FIG. 23 is an explanatory, perspective view showing how to connect blocks of the second group and the 11th block to each other in three dimensions.

FIG. 23 shows a modification of the structure shown in FIG. 19. The structure shown in FIG. 23 is formed by inserting an 11th block 112, instead of a first block 102, into the lacking portions M' of a pair of tenth blocks 111 placed adjacently. Alternatively, a 12th block 113, instead of the 11th block 112, may be inserted into the corresponding lacking portions M' of the tenth blocks 111, although not shown in the figure.

Figure 24:
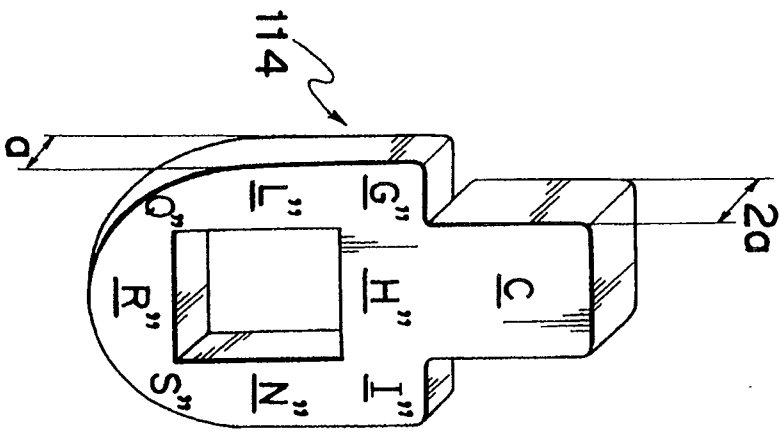
FIG. 24 is a front, perspective view showing a 13th block not belonging to the first nor to the second group.

A 13th block 114 shown in FIG. 24 is similar to the seventh block 108 shown in FIG. 14 in its configuration. The 13th block 114 comprises each block G", H", I", L", N", Q", R", and S" formed by reducing the seventh, eighth, ninth, 12th, 14th, 17th, 18th, and 19th unit block G, H, I, L, N, Q, R, and S by half in a direction of thickness of the 13th block 114 and rounding off the corners of the 12th, 14th, 17th, 18th, 19th unit block L, Q, R, S, and N semicircularly; and the third unit block C connected to the block H" such that the back half of the unit block C projects rearward of the back surface level of the block H" by a unit (a) with the front surface of the unit block C being flush with that of the block H".

Figure 25:
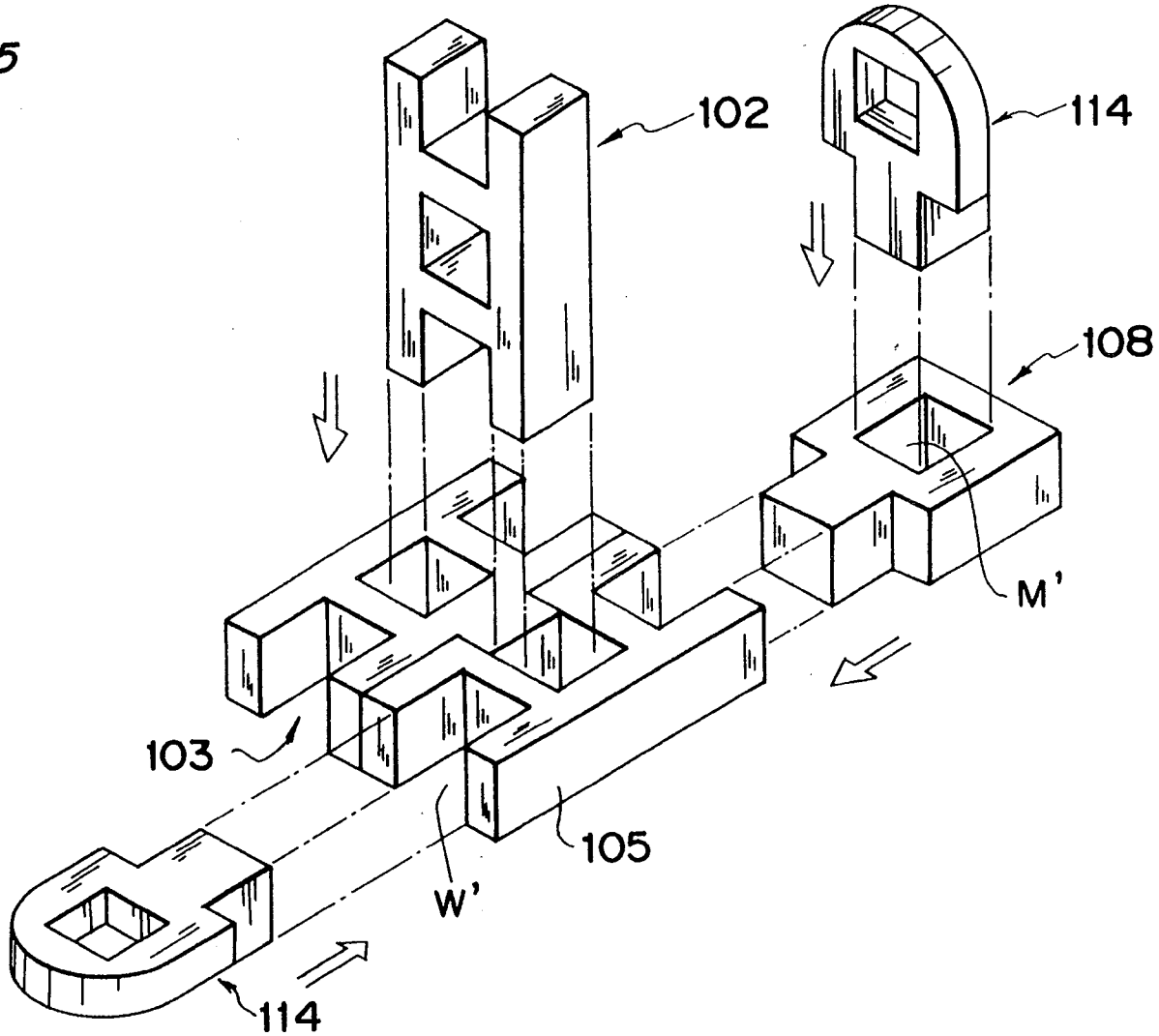
FIG. 25 is an explanatory, perspective view showing how to connect blocks of the first and second group, and the 13th blocks to each other in two and three dimensions.

As shown in FIG. 25, the 13th block 114 can be connected to a block of the first or second group. In this example, each unit block C of the 13th blocks 114 is inserted into the lacking portion W' of a fourth block 105 and the lacking portion M' of a seventh block 108, respectively.

As apparent from the above description, the use of blocks selected form the modified blocks 112–114 in combination with blocks selected from the first and/or second group can expand the diversity of configurations of the block toy.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A block toy comprising:

a combination of different types of desired blocks selected from blocks belonging to six different types of blocks, namely a first to a sixth block each of which is symmetrical with respect to a line, each of which is formed by connecting at least one desired unit block selected from a 11th through a 15th unit block (K–O) to essential unit blocks including a second, fourth, seventh, eighth, ninth, 17th, 18th, 19th, 22nd and 24th unit block (B, D, G, H, I, Q, R, S, V and X), at least one of said desired blocks including at least a 11th (K) or a 15th (O) unit block, wherein the twenty-five unit blocks from a first to a 25th unit block (A–Y) are formed from a rectangular base block 8×a in vertical length, 6×a in horizontal length and 2×a in thickness by dividing the base block by four vertical cutting planes from a first to a fourth plane arranged from left to right in parallel with each other and by four horizontal cutting planes from a first to a fourth plane arranged from top to bottom in parallel with each other, designating a unit block at a left upper corner of the base block the first unit block (A), a unit block at a right lower corner thereof the 25th unit block (Y), and each of the other unit blocks the second to the 24th unit block (B–X), respectively, arranged from an upper first to a lower fifth row and from a left first to a right fifth column, that a vertical length of each unit block (A–E, K–O and U–Y) on the first, third and fifth row is 2×a whereas a vertical length of each unit block (F–J and P–T) on the second and fourth row is "a", and that a horizontal length of each unit block (A, B, D, E, F, G, I, J, K, L, N, O, P, Q, S, T, U, V, X and Y) on the first, second, fourth and fifth column is "a" whereas a horizontal length of each unit block (C, H, M, R and W) on the third column is 2×a.

2. A block toy as claimed in claim 1, further comprising any desired blocks selected from blocks belonging to four different types of blocks, namely a seventh to a tenth block each of which is symmetrical with respect to a line, each of which is formed by connecting at least one desired unit block selected from the second through fourth unit blocks (B–D) and/or the 22nd through 24th unit blocks (V–X) to essential unit blocks including the seventh, eighth, ninth, 12th, 14th, 17th, 18th and 19th unit blocks (G, H, I, L, N, Q, R and S).

3. A block toy as claimed in claim 1, further comprising a 11th block, the 11th block comprising modified unit blocks (B/2, D/2, V/2 and X/2) each of which is formed by vertically reducing the second, fourth, 22nd and 24th unit blocks (B, D, V and X) by half respectively, wherein the modified second unit block (B/2) is connected to the seventh unit block (G); the modified fourth unit block (D/2) is connected to the ninth unit block (I); the modified 22nd unit block (V/2) is connected to the 17th unit block (Q); and the modified 24th unit block (X/2) is connected to the 19th unit block (S).

4. A block toy as claimed in claim 1, further comprising a 12th block, the 12th block comprising modified unit blocks (B/2, D/2, L/2, M/2, N/2, V/2 and X/2) each of which is formed by vertically reducing the second, fourth, 12th, 13th, 14th, 22nd and 24th unit block (B, D, L, M, N, V and X) by half respectively, wherein the modified 12th unit block (L/2) is connected to the seventh, modified 13th, and 17th unit blocks (G, M/2 and Q); the modified 14th unit block (N/2) is connected to the 9th, modified 13th, and 19th unit blocks (I, M/2 and S); the modified second unit block (B/2) is connected to the seventh unit block (G); the modified fourth unit block (D/2) is connected to the ninth unit block (I); the modified 22nd unit block (V/2) is connected to the 17th unit block (Q); and the modified 24th unit block (X/2) is connected to the 19th unit block (S).

5. A block toy as claimed in claim 1, further comprising a 13th block, the 13th block comprising modified unit blocks (G", H", I", L", N", Q", R" and S") each of which is formed by reducing the seventh, eighth, ninth, 12th, 14th, 17th, 18th and 19th unit blocks (G, H, I, L, N, Q, R and S) by half in a thickness direction respectively, and the third unit block (C), connected to each other so that the third unit block (C) projects only on one side in the thickness direction.

6. A block toy as claimed in claim 2, further comprising a 11th block, the 11th block comprising modified unit blocks (B/2, D/2, V/2 and X/2) each of which is formed by vertically reducing the second, fourth, 22nd, and 24th unit blocks (B, D, V and X) by half respectively, wherein the modified second unit block (B/2) is connected to the seventh unit block (G); the modified fourth unit block (D/2) is connected to the ninth unit block (I); the modified 22nd unit block (V/2) is connected to the 17th unit block (Q) ; and the modified 24th unit block (X/2) is connected to the 19th unit block (S).

7. A block toy as claimed in claim 2, further comprising a 12th block, the 12th block comprising modified unit blocks (B/2, D/2, L/2, M/2, N/2, V/2 and X/2) each of which is formed by vertically reducing the second, fourth, 12th, 13th, 14th, 22nd and 24th unit block (B, D, L, M, N, V and X) by half respectively, wherein the modified 12th unit block (L/2) is connected to the seventh, modified 13th, and 17th unit blocks (G, M/2 and Q); the modified 14th unit block (N/2) is connected to the 9th, modified 13th, and 19th unit blocks (I, M/2 and S); the modified second unit block (B/2) is connected to the seventh unit block (G); the modified fourth unit block (D/2) is connected to the ninth unit block (I); the modified 22nd unit block (V/2) is connected to the 17th unit block (Q); and the modified 24th unit block (X/2) is connected to the 19th unit block (S).

8. A block toy as claimed in claim 2, further comprising a 13th block, the 13th block comprising modified unit blocks (G", H", I", L", N", Q", R" and S") each of which is formed by reducing the seventh, eighth, ninth, 12th, 14th, 17th, 18th and 19th unit blocks (G, H, I, L, N, Q, R and S) by half in a thickness direction respectively, and the third unit block (C), connected to each other so that the third unit block (C) projects only on one side in the thickness direction.

9. A block toy as claimed in claim 3, further comprising a 12th block, the 12th block comprising modified unit blocks (B/2, D/2, L/2, M/2, N/2, V/2and X/2) each of which is formed by vertically reducing the second, fourth, 12th, 13th, 14th, 22nd and 24th unit block (B, D, L, M, N, V and X) by half respectively, wherein the modified 12th unit block (L/2) is connected to the seventh, modified 13th, and 17th unit blocks (G, M/2 and Q); the modified 14th unit block (N/2) is connected to the 9th, modified 13th, and 19th unit blocks (I, M/2and S); the modified second unit block (B/2) is connected to the seventh unit block (G); the modified fourth unit block (D/2) is connected to the ninth unit block (I); the modified 22nd unit block (V/2) is connected to the 17th unit block (Q); and the modified 24th unit block (X/2) is connected to the 19th unit block (S).

10. A block toy as claimed in claim 3, further comprising a 13th block, the 13th block comprising modified unit blocks (G", H", I", L", N", Q", R" and S") each of which is formed by reducing the seventh, eighth, ninth, 12th, 14th, 17th, 18th and 19th unit blocks (G, H, I, L, N, Q, R and S) by half in a thickness direction respectively, and the third unit block (C), connected to each other so that the third unit block (C) projects only on one side in the thickness direction.

11. A block toy as claimed in claim 4, further comprising a 13th block, the 13th block comprising modified unit blocks (G", H", I", L", N", Q", R" and S") each of which is formed by reducing the seventh, eighth, ninth, 12th, 14th, 17th, 18th and 19th unit blocks (G, H, I, L, N, Q, R and S) by half in a thickness direction respectively, and the third unit block (C), connected to each other so that the third unit bock (C) project only on one side in the thickness direction.

12. A block toy as claimed in claim 6, further comprising a 12th block, the 12th block comprising modified unit blocks (B/2, D/2, L/2, M/2, N/2, V/2 and X/2) each of which is formed by vertically reducing the second, fourth, 12th, 13th, 14th, 22nd and 24th unit block (B, D, L, M, N, V and X) by half respectively, wherein the modified 12th unit block (L/2) is connected to the seventh, modified 13th, and 17th unit blocks (G, M/2 and Q); the modified 14th unit block (N/2) is connected to the 9th, modified 13th, and 19th unit blocks (I, M/2 and S); the modified second unit block (B/2) is connected to the seventh unit block (G); the modified fourth unit block (D/2) is connected to the ninth unit block (I); the modified 22nd unit block (V/2) is connected to the 17th unit block (Q); and the modified 24th unit block (X/2) is connected to the 19th unit block (S).

13. A block toy as claimed in claim 6, further comprising a 13th block, the 13th block comprising modified unit blocks (G", H", I", L", N", Q", R" and S") each of which is formed by reducing the seventh, eighth, ninth, 12th, 14th, 17th, 18th and 19th unit blocks (G, H, I, L, N, Q, R and S) by half in a thickness direction respectively, and the third unit block (C), connected to each other so that the third unit block (C) projects only on one side in the thickness direction.

14. A block toy as claimed in claim 7, further comprising a 13th block, the 13th block comprising modified unit blocks (G", H", I", L", N", Q", R" and S") each of which is formed by reducing the seventh, eighth, ninth, 12th, 14th, 17th, 18th and 19th unit blocks (G, H, I, L, N, Q, R and S) by half in a thickness direction respectively, and the third unit block (C), connected to each other so that the third unit block (C) projects only on one side in the thickness direction.

15. A block toy as claimed in claim 9, further comprising a 13th block, the 13th block comprising modified unit blocks (G", H", I", L", N", Q", R" and S") each of which is formed by reducing the seventh, eighth, ninth, 12th, 14th, 17th, 18th, and 19th unit blocks (G, H, I, L, N, Q, R and S) by half in a thickness direction respectively, and the third unit block (C), connected to each other so that third unit block (C) projects only on one side in the thickness direction.

16. A block toy as claimed in claim 12, further comprising a 13th block, the 13th block comprising modified unit blocks (G", H", I", L", N", Q", R" and S") each of which is formed by reducing the seventh, eighth, ninth, 12th, 14th, 17th, 18th, and 19th unit blocks (G, H, I, L, N, Q, R and S) by half in thickness direction respectively, and the third unit block (C), connected to each other so that third unit block (C) projects only on one side in the thickness direction.

17. A block toy comprising:

a combination of different types of desired blocks selected from blocks belonging to six different types of blocks, namely a first to a sixth block each of which is symmetrical with respect to a line, each of which is formed by connecting at least one desired unit block selected from a 11th through a 15th unit block (K–O) to essential unit blocks including a second, fourth, seventh, eighth, ninth, 17th, 18th, 19th, 22nd and 24th unit block (B, D, G, H, I, Q, R, S, V and X), at least one of said desired blocks including a 12th unit block (L) or a 14th unit block (N) as a sole connection between the second, fourth, seventh, eighth, and ninth essential unit blocks (B, D, G, H, I) and the 17th, 18th, 19th, 22nd and 24th essential unit blocks (Q, R, S, V, X), wherein twenty-five unit blocks from a first to a 25th unit blocks (A–Y) are formed from a rectangular base block 8×a in vertical length, 6×a in horizontal length and 2×a in thickness by dividing the base block by four vertical cutting planes from a first to a fourth plane arranged from left to right in parallel with each other and by four horizontal cutting planes from a first to a fourth plane arranged from top to bottom in parallel with each other, designating a unit block at a left upper corner of the base block the first unit block (A), a unit block at a right lower corner thereof the 25th unit block (Y), and each of the other unit blocks the second to the 24th unit block (B–X), respectively, arranged from an upper first to a lower fifth row and from a left first to a right fifth column, that a vertical length of each unit block (A–E, K–O and U–Y) on the first, third and fifth row is 2×a whereas a vertical length of each unit block (F–J and P–T) on the second and fourth row is "a", and that a horizontal length of each unit block (A, B, D, E, F, G, I, J, K, L, N, 0, P, Q, S, T, U, V, X and Y) on the first, second, fourth and fifth column is "a" whereas a horizontal length of each unit block (C, H, M, R and W) on the third column is 2×a.

18. A block toy as claimed in claim 17, further comprising any desired blocks selected from blocks belonging to four different types of blocks, namely a seventh to a tenth block each of which is symmetrical with respect to a line, each of which is formed by connecting at least one desired unit block selected from the second through fourth unit blocks (B–D) and/or the 22nd through 24th unit blocks (V–X) to essential unit blocks including the seventh, eighth, ninth, 12th, 14th, 17th, 18th and 19th unit blocks (G, H, I, L, N, Q, R and S).

19. A block toy as claimed in claim 17, further comprising a 11th block, the 11th block comprising modified unit blocks (B/2, D/2, V/2 and X/2) each of which is formed by vertically reducing the second, fourth, 22nd and 24th unit blocks (B, D, V and X) by half respectively, wherein the modified second unit block (B/2) is connected to the seventh unit block (G); the modified fourth unit block (D/2) is connected to the ninth unit block (I); the modified 22nd unit block (V/2) is connected to the 17th unit block (Q); and the modified 24th unit block (X/2) is connected to the 19th unit block (S).

20. A block toy as claimed in claim 17, further comprising a 12th block, the 12th block comprising modified unit blocks (B/2, D/2, L/2, M/2, N/2, V/2and X/2) each of which is formed by vertically reducing the second, fourth, 12th, 13th, 14th, 22nd and 24th unit block (B, D, L, M, N, V and X) by half respectively, wherein the modified 12th unit block (L/2) is connected to the seventh, modified 13th, and 17th unit blocks (G, M/2and Q); the modified 14th unit block (N/2) is connected to the 9th, modified 13th, and 19th unit blocks (I, M/2and S); the modified second unit block (B/2) is connected to the seventh unit block (G); the modified fourth unit block (D/2) is connected to the ninth unit block (I); the modified 22nd unit block (V/2) is connected to the 17th unit block (Q); and the modified 24th unit block (X/2) is connected to the 19th unit block (S).

21. A block toy as claimed in claim 17, further comprising a 13th block, the 13th block comprising modified unit blocks (G″, H″, I″, L″, N″, Q″, R″ and S″) each of which is formed by reducing the seventh, eighth, ninth, 12th, 14th, 17th, 18th and 19th unit blocks (G, H, I, L, N, Q, R and S) by half in a thickness direction respectively, and the third unit block (C), connected to each other so that the third unit block (C) projects only on one side in the thickness direction.

* * * * *